US007887205B1

(12) United States Patent
Knoble et al.

(10) Patent No.: US 7,887,205 B1
(45) Date of Patent: Feb. 15, 2011

(54) ROTATABLE EMERGENCY LIGHT WITH DIRECT DRIVE MOTOR

(75) Inventors: David Knoble, Tupelo, MS (US); Khosrow Jamasbi, Belden, MS (US)

(73) Assignee: Genlyte Thomas Group LLC, Lousville, KY (US)

( * ) Notice: Subject to any disclaimer, the term of this patent is extended or adjusted under 35 U.S.C. 154(b) by 188 days.

(21) Appl. No.: 12/164,791

(22) Filed: Jun. 30, 2008

Related U.S. Application Data

(60) Provisional application No. 60/947,179, filed on Jun. 29, 2007.

(51) Int. Cl.

| | |
|---|---|
| ***F21S 9/00*** | (2006.01) |
| ***F21S 8/02*** | (2006.01) |
| ***F21V 1/14*** | (2006.01) |
| ***F21V 19/04*** | (2006.01) |

(52) U.S. Cl. ..... 362/20; 362/272; 362/286; 362/147

(58) Field of Classification Search ..... 362/147, 362/20, 271, 272, 276, 285–287, 364–366, 362/249.03–249.11, 418–420, 422–424
See application file for complete search history.

(56) References Cited

U.S. PATENT DOCUMENTS

| | | | | |
|---|---|---|---|---|
| 4,802,065 | A * | 1/1989 | Minter et al. | 362/20 |
| 6,164,788 | A * | 12/2000 | Gemmell et al. | 362/20 |
| 6,371,621 | B1 * | 4/2002 | Le Bel | 362/20 |
| 7,654,710 | B2 * | 2/2010 | Williams et al. | 362/386 |
| 2008/0239709 | A1 * | 10/2008 | Rapeanu et al. | 362/147 |

* cited by examiner

*Primary Examiner*—Bao Q Truong

(57) ABSTRACT

An emergency lighting system comprises a wall unit housing that may readily be located and secured between wall studs in a conventional structure. The housing includes a rotatable door to which an emergency lamp is secured, said door being in a closed position when main electrical power is on such that the lamp is hidden within the housing. The rotatable door is coupled to a motor that is supplied battery power when main electrical power loss is detected, thereby rotating the door to an open position and exposing the emergency lamps. The emergency lamps are also illuminated by battery power.

16 Claims, 9 Drawing Sheets

ROTATABLE EMERGENCY LIGHT WITH DIRECT DRIVE MOTOR

CROSS-REFERENCE TO RELATED APPLICATIONS

This application claims the benefit of copending U.S. Provisional Patent Application Ser. No. 60/947,179 filed Jun. 29, 2007 and entitled "Emergency Light with Direct Drive Motor".

BACKGROUND OF THE INVENTION

Field of the Invention

The present invention relates generally to a rotatable exit light that activates automatically when other power sources go out. More particularly, the invention relates to a rotatable emergency exit light having a direct drive motor.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE DRAWINGS

Figure 1:
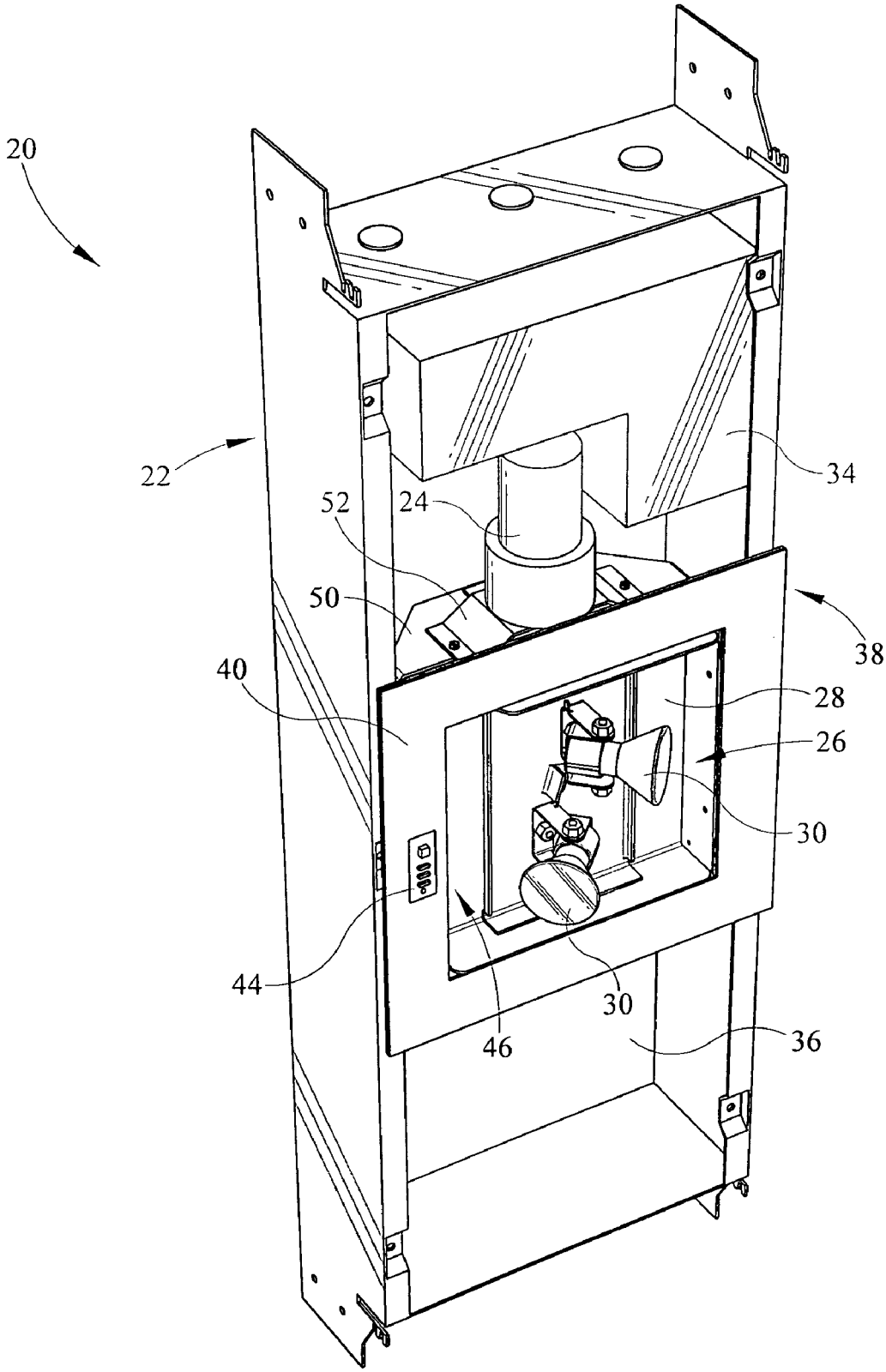
FIG. 1 is a perspective view of an embodiment of the emergency light of the invention when the light is in use.

While this invention is capable of embodiments in many different forms, multiple embodiments are shown in the drawing Figures and will be herein described in detail. The present disclosure is to be considered an exemplification of the principles of the invention and is not intended to limit the broad aspects of the invention to the embodiments illustrated.

Figure 2:
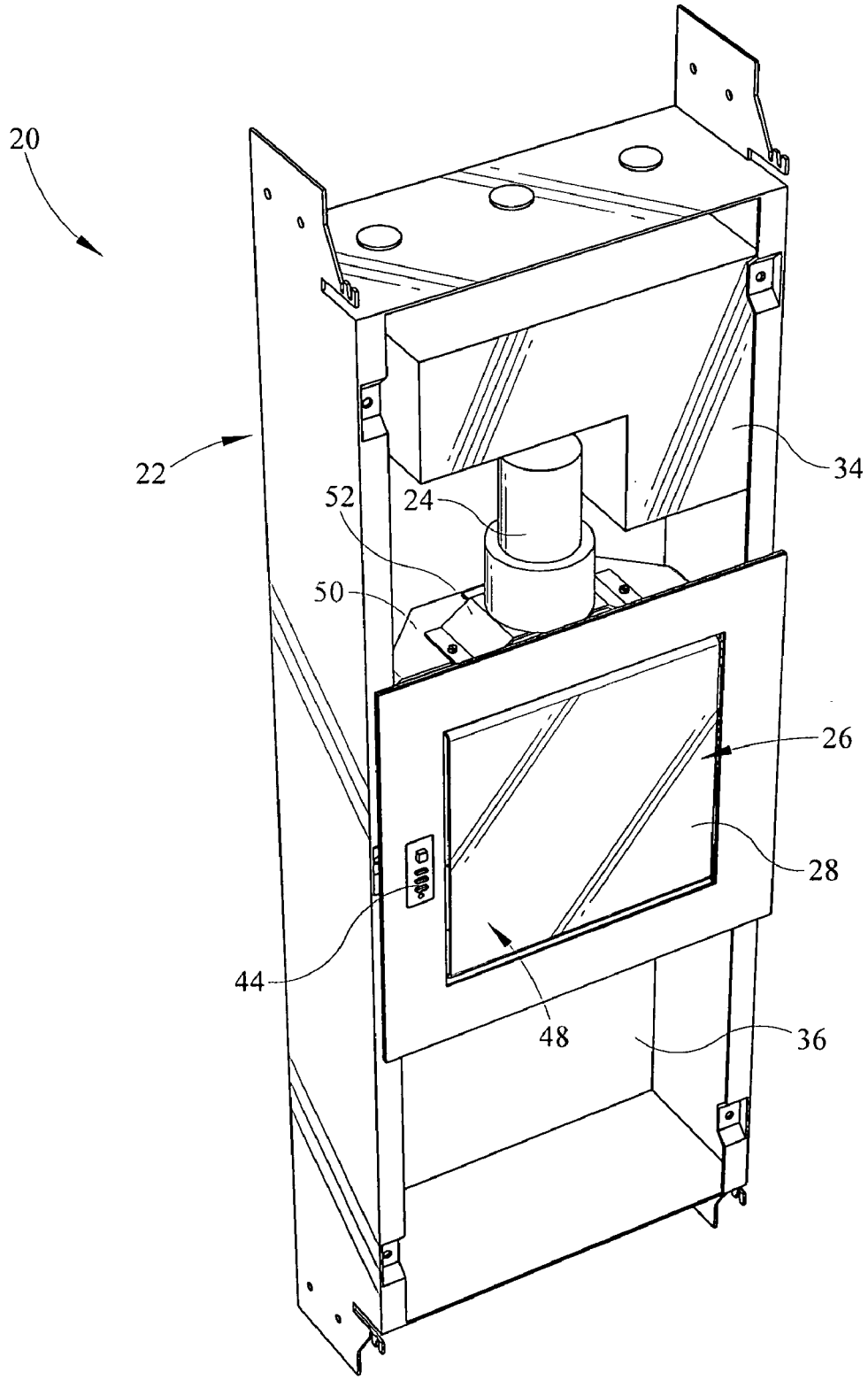
FIG. 2 is a perspective view of an embodiment of the emergency light of the invention when the light is not in use.

Turning now to the drawing Figures, and to FIGS. 1 and 2 in particular, one embodiment of the emergency light in which the emergency light is part of a wall unit 20 comprises a rectangular housing 22 comprising a direct-drive motor 24 and rotating door assembly 26 of the invention. The rotating door assembly 26 comprises a rotating door 28 with a first side 46 and a second side 48. There are a plurality of lights (lamps) 30 on first side 46 of the rotating door 28, as seen in FIG. 1. FIG. 1 also shows first side 46 of rotating door 28 with lights 30 deployed. FIG. 2 shows second side 48 of rotating door 28 where in door 28 is closed and lights 30 are undeployed.

Figure 3:
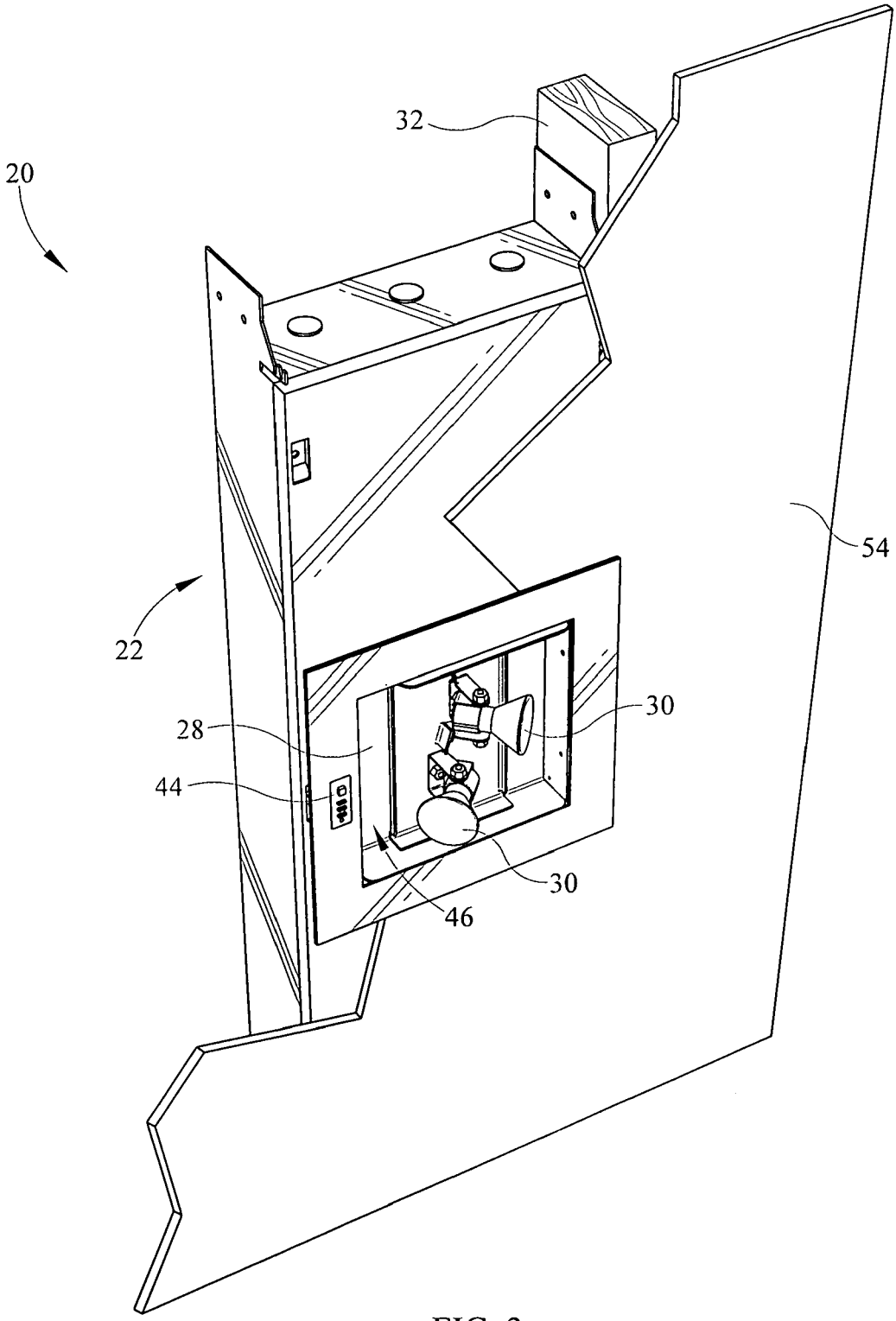
FIG. 3 is a cut-away perspective view of an embodiment of the invention after installation in a wall.

When installed in the wall, rectangular housing 22 may be positioned such that its length is oriented vertically. The rectangular housing 22 is narrow enough to fit between a pair of opposed studs 32 in the wall, as shown in FIG. 3. When rectangular housing 22 is vertically positioned, rotating door assembly 26 is positioned approximately in the middle of the rectangular housing 22, while motor 24 and a component case 34 that contains a microprocessor and a charger board (not shown) as well as other electrical components of the wall unit 20 are located above door assembly 26. The bottom 36 of rectangular housing 22 shown in FIGS. 1 and 2 is empty, but in other embodiments of the invention it may include a battery, such as a lead-acid battery or a nickel-cadmium battery. The battery may be sufficiently large so as to provide enough energy to accommodate two 36 watt lights 30. In one embodiment of the invention the battery is a 12 volt dc, 12 ampere-hour battery. In an alternative embodiment, the lights 30 may consume less than 36 watts of power so that the battery could also power a remote light 30 away from wall unit 20.

Referring again to FIGS. 1 and 2, rotating door assembly 26 includes a frame assembly 38 in which rotating door 28 is mounted. Frame assembly 38 comprises a frame cap 40 and a frame base 42, but only frame cap 40 is visible in FIGS. 1 and 2. The frame base 42 can be seen in FIG. 4. A diagnostic control panel 44 is disposed one side of frame cap 40. Diagnostic control panel 44 can be used to determine whether the wall unit 20 is functional. Diagnostic panel 44 may comprise a control switch that, when depressed, initiates diagnostic testing of unit 20. A plurality of LED's are also included on diagnostic panel 44. In one embodiment of the invention there are three LED's on panel 44, which are labeled "Changer", "Lamp", and "Battery" and which are electronically coupled to signals from the charger board. A flashing LED indicates a defect or malfunction that requires attention from a technician. First side 46 of rotating door 28 includes at least one light 30, and in the embodiment shown in FIG. 1, includes two lights 30. Also in FIGS. 1 and 2, adjacent to the direct drive motor 24 is a motor end cap 50 and an end cap brace 52. End cap brace 52 is directly adjacent to direct drive motor 24 and is mounted to motor end cap 50.

FIG. 3 depicts wall unit 20 in a wall 54. Wall 54 shown in FIG. 3 is made of sheet rock, but it may be made of a number of different substances, such as plaster or wood. Wall 54 typically comprises a plurality of spaced vertical studs 32 between which the unit is placed. In FIG. 3, rectangular housing 22 of wall unit 20 is placed adjacent to wall stud 32 thence attached thereto 32, which holds it in place. Wall unit 20 shown in FIG. 3 includes component case 34 and bottom 36 covered to protect electrical components of wall unit 20 from being damaged.

In the embodiment shown in FIG. 3, door 28 is open so that the lights 30 attached to first side 46 are visible. As demonstrated in FIG. 3, emergency lighting wall unit 20 may be disposed in the wall 54. Although lights 30 are visible in FIG. 3, when emergency lights 30 are not in operation, the second side of rotating door 28 is facing outward so that the presence of wall unit 20 does not greatly alter the aesthetics of wall 54. If electrical power is lost, rotating door 28 rotates to reveal lights 30 so that door 28 is in the position depicted in FIG. 3.

Figure 4:
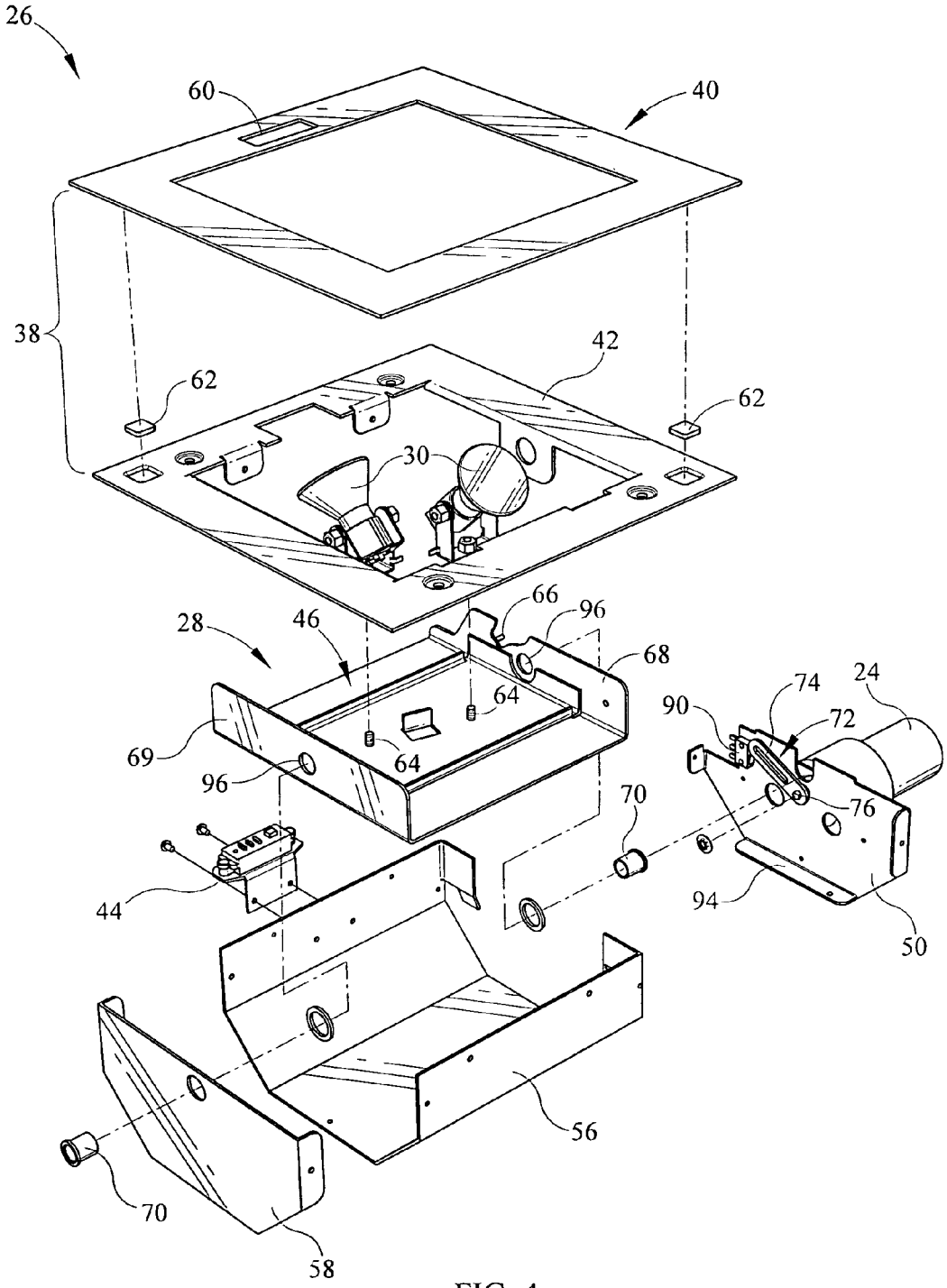
FIG. 4 is an exploded view of an embodiment of the rotating door assembly of the invention.

FIG. 4 shows an exploded view of rotating door assembly 26 of the invention. Rotating door assembly 26 generally comprises a frame assembly 38, a rotating door 28, a base 56, a motor end cap 50, and a second end cap 58. As previously discussed in reference to FIGS. 1 and 2, frame assembly 38 comprises a frame cap 40 and a frame base 42. As shown in FIG. 4, frame cap 40 has an opening 60 through which the diagnostic control panel 44, shown in FIGS. 1 and 2, is inserted. Below frame cap 40 is frame base 42. Two magnets 62 are positioned in the corners of frame base 42. These magnets 62 exert a magnetic force that hold the frame cap 40 in place against frame base 42.

Located below frame base 42 is rotating door 28. Rotating door 28 includes two screws 64 or like fasteners to secure lights 30 thereto. Rotating door 28 is positioned to be recessed within base 56, and further has first and second opposed side plates 68, 69 that provide depth such that lights 30 fit within rotating door assembly 26 and only become visible when the door 28 rotates. The side plates 68, 69 are on opposed ends of door 28. First side 68 is adjacent to motor end cap 50, and second side 69 is adjacent the second end cap 52. First and second sides 68, 69 each have an aperture 96 through which bolts 70 rotatably attach motor end cap 50 and second end cap 52, respectively, to door 28. Motor end cap 50 and second end cap 52 affix to base 56 utilizing conventional fasteners and enclose base 56 and door assembly 26. Motor end cap 50 has a lip 94 that supports base 56 and helps hold it in place. Also attached to first side 68 of rotating door 28 is a pin 66, which engages with motor end cap 50 as discussed below.

Figure 5:
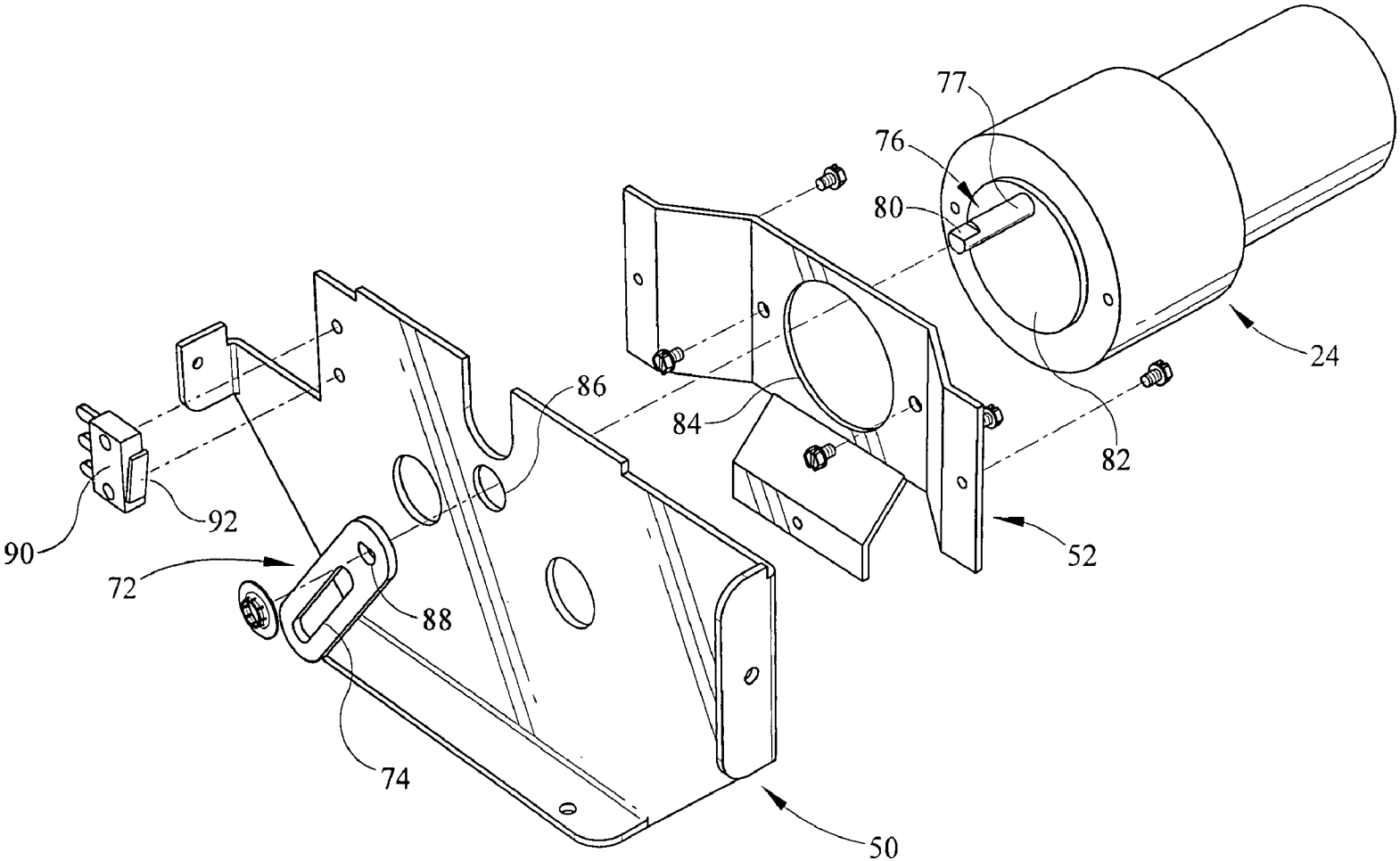
FIG. 5 is an exploded view of an embodiment of the motor and lever of the invention.

Motor end cap 50 of the wall unit 20 attaches to first side 68 of the door 28, but in FIG. 4, it is positioned below the door 28. FIG. 5 shows an exploded view of motor end cap 50, the end cap brace 52, direct drive motor 24, and other parts. Motor 24 includes a shaft 76 that is offset from a central axis of motor 24. In the embodiment shown in FIG. 5, shaft 76 is circular at a first end 77 attached to the motor 24, and further has a second end 78 with a notch 80 therein.

Figure 6:
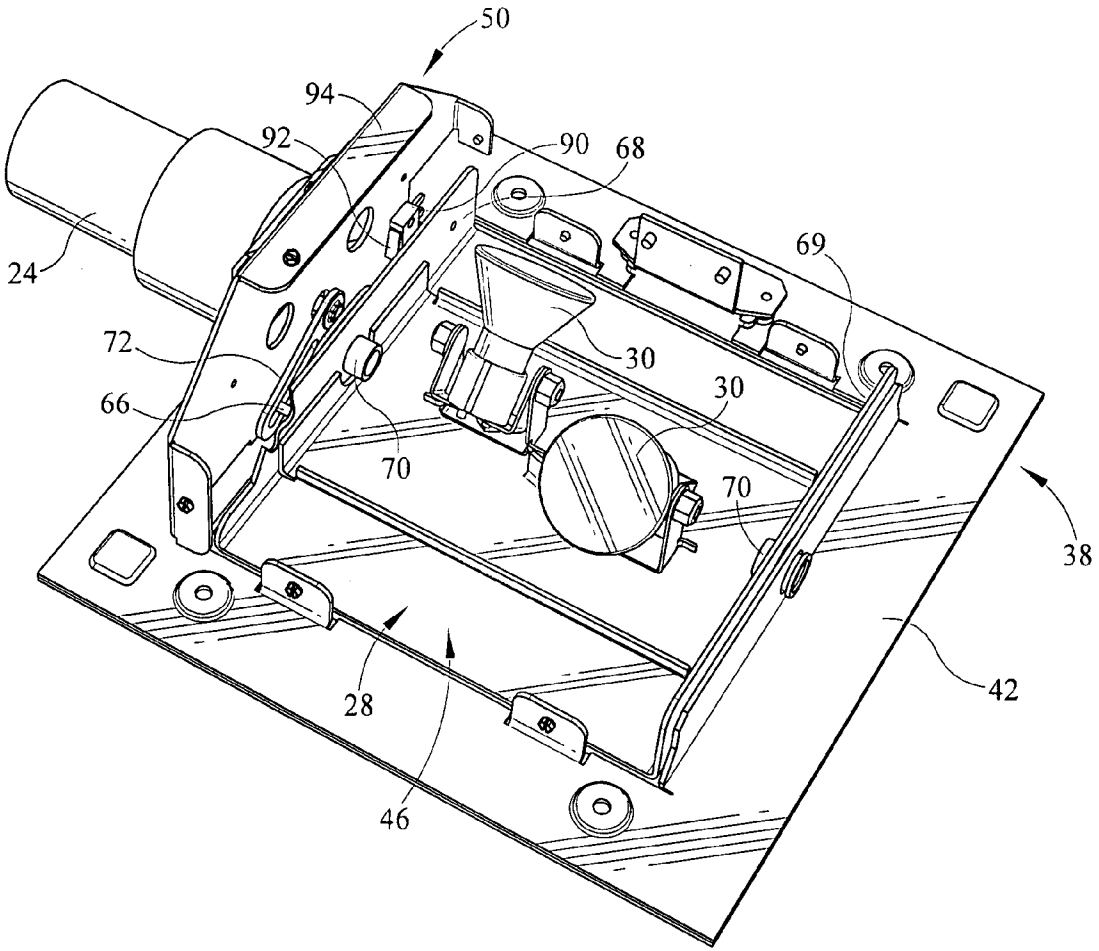
FIG. 6 is a back perspective view of an embodiment of the rotating door invention.
Figure 7:
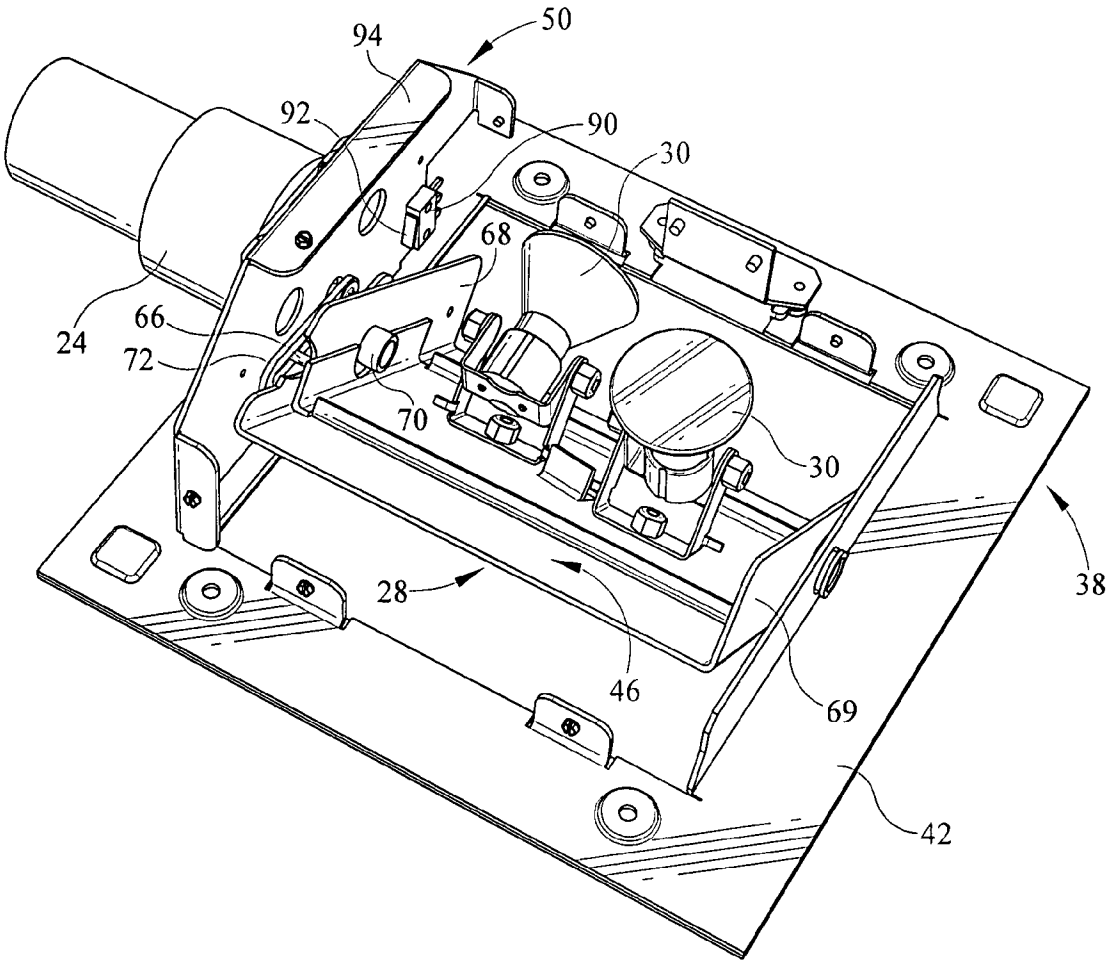
FIG. 7 is a back perspective view of an embodiment of the rotating door invention.
Figure 8:
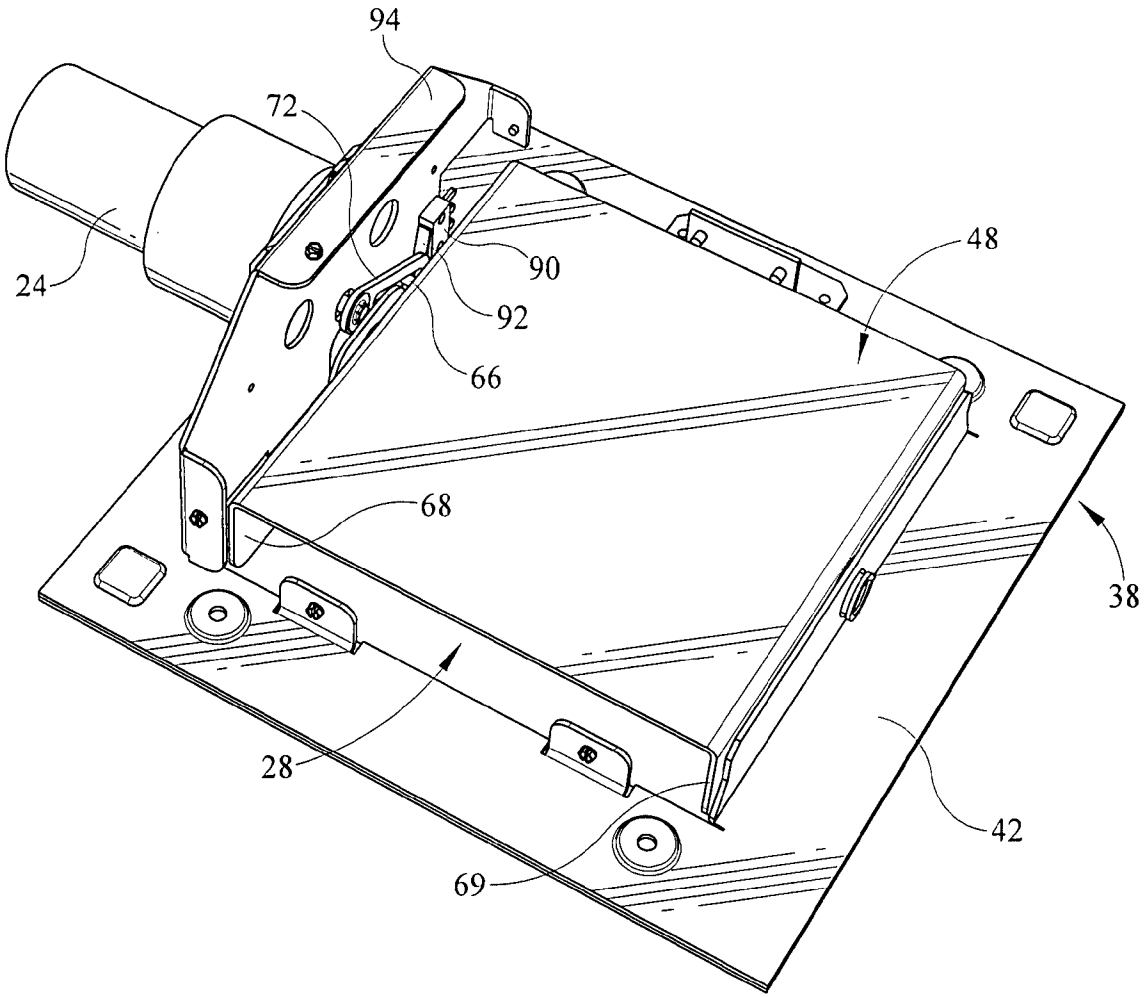
FIG. 8 is a back perspective view of an embodiment of the rotating door invention.

In the embodiment shown in FIG. 5, direct drive motor 24 has a raised flange 82 to which the shaft 76 is attached. The flange 82 nests into a corresponding aperture 84 in end cap brace 52 so that their respective surfaces are in a mating relationship. Shaft 76 is positioned through a circular aperture 86 on end cap 50 such that second end 78 is inserted into a notched opening 88 on a lever 72. Lever 72 also includes an elongated slot 74 in which pin 66 of rotating door 28 is positioned, as can be seen in FIGS. 6, 7 and 8. Also secured to end cap 50 is a sensor 90 having a switch 92 for detecting when rotating door 28 has opened, as will be discussed below.

The emergency lighting system of wall unit 20 is designed to open when electrical power is lost, at which time the conventional lighting system of a building—a hospital, for example—would go out. The opening process is shown in FIGS. 6-8, which illustrate back views of the wall unit 20. FIG. 6 shows door 28 in a closed position where first side 46 of rotating door 28 having lights 30 is facing toward the inside of the wall (not shown). With door 28 in this position, when electrical power goes out, wall unit 20 detects this condition by operation of an on board microprocessor, typically mounted within enclosure 34 along with a transformer for converting line voltage to a lower voltage, and the concomitant batteries and diagnostic electronics required mounted on a charger board to detect power loss and turn on emergency lights. In one embodiment of the invention the microprocessor detects power loss by monitoring the presence of line power at the low voltage side of the transformer. The charger board circuitry then switches battery power to motor 24 whereupon motor 24 then turns accordingly. As the motor 24 turns, flange 82 rotates, thereby turning rod 76 extending from its edge. The rod 76 does not rotate or move in any other way.

As previously stated, the notch 80 of shaft 76 extends through a notched opening 88 in lever 72. When the shaft 76 rotates around flange 82, lever 72 rotates, thereby causing the pin 66 to move along slot 74 of lever 72. Since pin 66 is attached to rotating door 28, door 28 rotates around an axis through apertures 96 and starts to open, as shown in FIG. 7. Motor 24 turns until pin 66 reaches the other end of slot 74 so that lever 72 cannot move any further. Lever 72 also contacts opposite sensor 90 switch 92 at approximately this time, as shown in FIG. 8. Although lever 72 cannot move any further, the motor 24 operates on a timed signal prior to stopping such that it turns for a predetermined time period before skipping. No separate gears are required.

Sensor 90 has a switch 92 contacts lever 72 after lever 72 rotates fully, thus indicating a fully opened door. Pin 66 contacts switch 92 on sensor 90 when door 28 is fully opened; if sensor 90 switch 92 is not contacted, the microprocessor notices the absence of a signal from sensor 90 and thus powers on an LED on panel 44 indicating door 28 malfunction.

During normal operation, door 28 will open and lights 30 will be illuminated when power is lost. During monthly self-testing which is initiated by the microprocessor at predetermined intervals the lights 30 will come on with door 28 closed, and then door 28 will open and close without the lights 30 on, so that people nearby will be less alarmed by a self-test. In this way, the self-test can confirm that the lights 30 come on and that the door 28 properly opens and closes.

Once electrical power is restored, the microprocessor provides a signal to motor 24 to rotate in the opposite direction for a predetermined time period, thereby rotating flange 82 and shaft 76, thus closing door 28.

Figure 9:
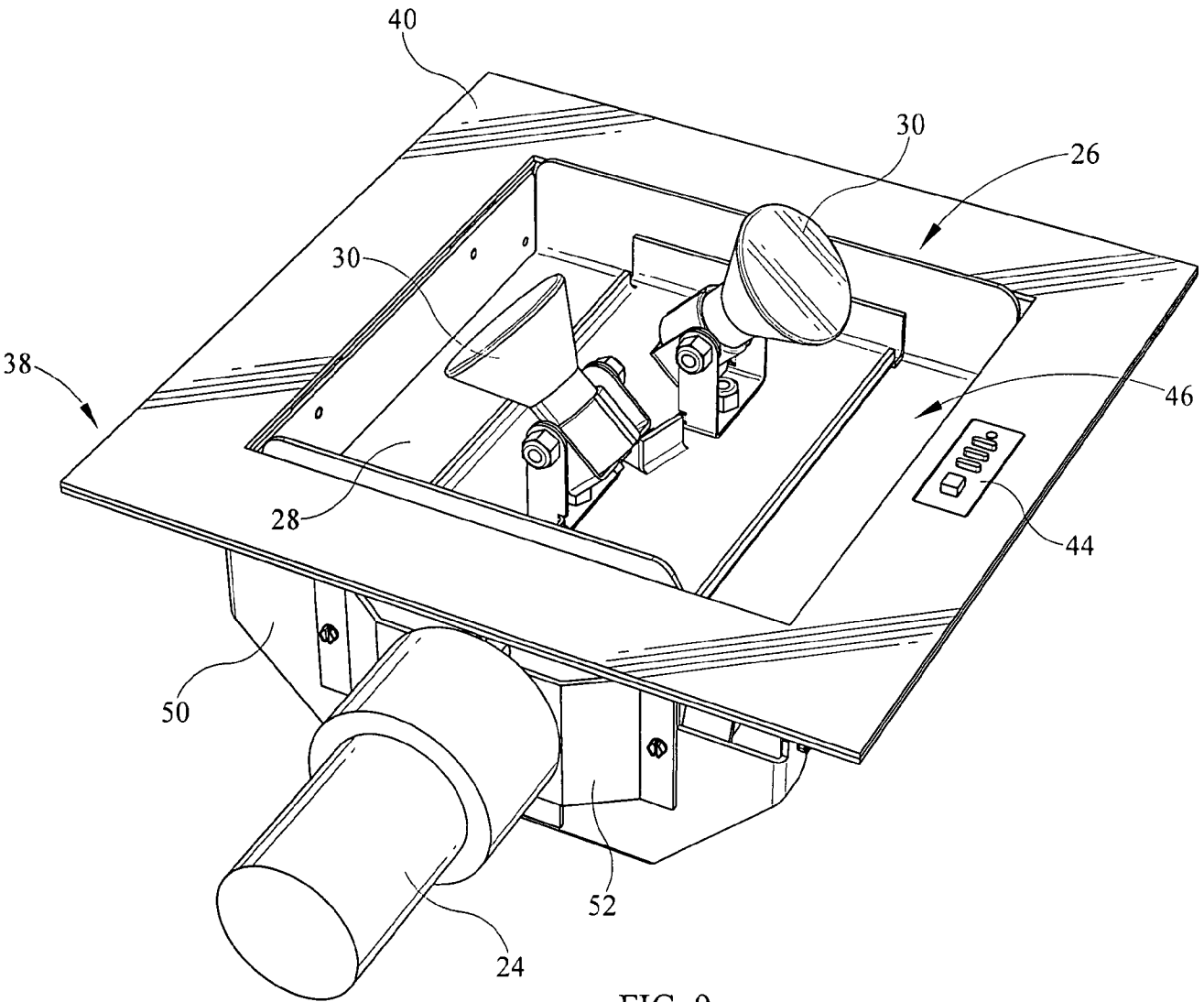
FIG. 9 is a front perspective view of an embodiment of the rotating door assembly of the invention.

FIG. 9 shows a front view of wall unit 20 after rotating door 28 has opened. In FIG. 9, first side 46 of rotating door 28 is visible and facing the outside. The lights 30 are visible and illuminated. Motor 24 has finished rotating in this view and is seen adjacent end cap brace 52 and motor end cap 50. Diagnostic control panel 44 is also visible in frame cap 40.

While there have been described what are believed to be the preferred embodiments of the present invention, those skilled in the art will recognize that other and further changes and modifications may be made thereto without departing from the spirit of the invention, and it is intended to claim all such changes and modifications as fall within the true scope of the invention.

The invention claimed is:

1. An emergency light assembly comprising:

a direct drive motor having a rotatable motor shaft extending therefrom;

a lever connected to said motor shaft;

a rotatable door having a first side and a second side, said first side facing inwardly and said second side facing outwardly when said door is in a closed position;

at least one light positioned on said first side of said rotatable door; and a pin secured to said rotatable door engaging said lever, wherein the rotation of said motor shaft causes rotation of said door through said lever and said pin;

wherein said lever has a notch therein engaged by said motor shaft and having a longitudinal slot in said lever which is slidably engaged by said pin; and wherein said lever rotates as said motor shaft rotates thereby causing said pin to slide in said lever slot as said lever rotates.

2. The emergency light assembly of claim 1 comprising:

said lever slot having a first end and second end, wherein said pin engages said slot at said first end when said rotatable door is in a closed position; and wherein said pin is located at said second end when said door is in an open position.

3. The emergency light assembly of claim 2 further comprising:

a microcontroller having a plurality of inputs and outputs for accepting and supplying electrical signals; and a sensor positioned to contact with said pin when said pin is in said second end of said slot, said sensor having an output electrically coupled to an input of said microprocessor.

4. The emergency light assembly of claim 1 further comprising:

a housing surrounding and containing said assembly;

a frame assembly secured to said housing and positioned around the periphery of said door; and a diagnostic control panel secured to said frame assembly.

5. The emergency light assembly of claim 1 further comprising:

a housing positioned within a wall surrounding said rotatable door, said motor, and said lever;

an enclosure within said housing; and a circuit board and electrical storage battery secured within said housing.

6. An emergency auxiliary light assembly for placement within a wall comprising:

a housing that can be positioned between two wall studs and secured thereto;

a motor having a rotatable shaft positioned in said housing;

a rotatable door within said housing, said rotatable door having a first side that faces inwardly when said door is closed and a second side, said door mechanically coupled to said motor shaft by a pin slidably extending into an elongated slot of a lever, said lever rotatably actuated by said motor shaft;

a lamp positioned on said first side of said door; and wherein rotation of said rotatable shaft causes rotation of said door thereby positioning the first side thereof to face outwardly by rotating said lever, said lever elongated slot sliding said pin of said rotatable door.

7. The emergency auxiliary light assembly of claim 6 wherein said motor shaft is rotatable to a first position whereby said first side of said door faces inwardly, and a second position whereby said first side of said door faces.

8. The emergency auxiliary light assembly of claim 7 wherein said lever has a first position and a second position corresponding to said first position and said second position of said motor shaft.

9. The emergency auxiliary light assembly of claim 8 wherein said motor shaft rotation stops at said second position.

10. The emergency auxiliary light assembly of claim 6 comprising:

said lever slot having a first end and second end wherein said pin is located at said first end when said door is in a closed position; and wherein said pin is located at said second end when said door is in an open position.

11. The emergency auxiliary light of claim 10 further comprising:

a sensor positioned to contact said pin when said pin is in said second end of said slot.

12. The emergency auxiliary light of claim 6 further comprising:

a frame assembly secured to said housing and located around the periphery of said door; and a diagnostic control switch secured to said frame assembly.

13. An emergency light assembly for supplying illumination upon loss of a main electrical power source comprising:

a housing enclosing said assembly for securing said assembly to a structure;

a base having first and second opposed end caps secured thereto, said first end cap having an aperture therein;

a direct drive motor having a rotatable shaft extending therefrom, said motor secured to said first end cap such that said shaft extends through said aperture;

a rotatable door rotatably secured to said end caps having a first inward-facing side and a second outward facing side, said inward-facing side having at least one lamp secured thereto; and wherein said said direct drive motor shaft is attached to said door by a pin extending from said door through an elongated slot in a lever, said lever actuated by said rotatable shaft of said motor so that said door opens when said motor shaft rotates.

14. An emergency light assembly as claimed in claim 13 comprising:

a battery for supplying electrical power to said motor; and a microcontroller having an input electrically coupled to said main source of electrical power for detecting the loss thereof, and an output for switching battery power to said motor for a predetermined time period.

15. An emergency light assembly as claimed in claim 14 comprising:

a transformer connected to said main source of electrical power; and wherein said microcontroller input is electrically coupled to a low voltage side of said transformer for detecting power loss.

16. An emergency light assembly as claimed in claim 15 comprising:

an enclosure within said housing containing said battery, said microcontroller and said transformer.

* * * * *